US009117407B2

(12) United States Patent
Kim

(10) Patent No.: US 9,117,407 B2
(45) Date of Patent: Aug. 25, 2015

(54) PIXEL CIRCUIT, METHOD OF DRIVING THE SAME, AND ORGANIC LIGHT EMITTING DISPLAY DEVICE HAVING THE SAME

(75) Inventor: Tae-Jin Kim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 417 days.

(21) Appl. No.: 13/529,515

(22) Filed: Jun. 21, 2012

(65) Prior Publication Data

US 2013/0194248 A1 Aug. 1, 2013

(30) Foreign Application Priority Data

Jan. 27, 2012 (KR) ..... 10-2012-0008159

(51) Int. Cl.
*G09G 3/30* (2006.01)
*G09G 3/32* (2006.01)
*G09G 3/36* (2006.01)

(52) U.S. Cl.
CPC ..... *G09G 3/3233* (2013.01); *G09G 3/3659* (2013.01); *G09G 2300/0819* (2013.01); *G09G 2300/0852* (2013.01); *G09G 2300/0861* (2013.01); *G09G 2310/0251* (2013.01); *G09G 2320/045* (2013.01)

(58) Field of Classification Search
CPC ..... G09G 3/30
USPC ..... 345/76, 211, 212
See application file for complete search history.

(56) References Cited

U.S. PATENT DOCUMENTS

| | | | | |
|---|---|---|---|---|
| 7,800,564 | B2 * | 9/2010 | Numao | 345/82 |
| 2009/0027310 | A1 * | 1/2009 | Kim | 345/76 |
| 2011/0157126 | A1 | 6/2011 | Chung et al. | |
| 2011/0164071 | A1 | 7/2011 | Chung et al. | |
| 2011/0193855 | A1 * | 8/2011 | Han | 345/214 |

FOREIGN PATENT DOCUMENTS

| | | |
|---|---|---|
| KR | 10-2011-0078387 | 7/2011 |
| KR | 10-2011-0079220 | 7/2011 |
| KR | 10-2011-0080040 | 7/2011 |

* cited by examiner

*Primary Examiner* — Pegeman Karimi
(74) *Attorney, Agent, or Firm* — Robert E. Bushnell, Esq.

(57) ABSTRACT

A method of driving a pixel circuit includes initializing a driving transistor and a storage capacitor by simultaneously applying an initialization voltage and a first power voltage to a gate electrode of the driving transistor and the storage capacitor, respectively, diode-coupling the driving transistor, applying a data voltage to the storage capacitor, applying the data voltage to the gate electrode of the driving transistor by a coupling of a compensation capacitor coupled between the gate electrode of the driving transistor and the storage capacitor, and applying a current corresponding to the first power voltage and the data voltage to an organic light emitting diode that is coupled to the driving transistor.

20 Claims, 18 Drawing Sheets

PIXEL CIRCUIT, METHOD OF DRIVING THE SAME, AND ORGANIC LIGHT EMITTING DISPLAY DEVICE HAVING THE SAME

CLAIM OF PRIORITY

This application makes reference to, incorporates the same herein, and claims all benefits accruing under 35 U.S.C. §119 from an application earlier filed in the Korean Intellectual Property Office on the 27 Jan. 2012 and there duly assigned Serial No. 10-2012-0008159.

BACKGROUND OF THE INVENTION

1. Field of the Invention

The present invention relates generally to a display device. More particularly, the invention relates to a pixel circuit, a method of driving the pixel circuit, and an organic light emitting display device having the pixel circuit.

2. Description of the Related Art

An organic light emitting display (OLED) device includes a plurality of scan-lines, a plurality of data-lines, and a plurality of pixel circuits that are arranged in a matrix form at crossing points of the scan-lines and the data-lines. Each pixel circuit includes a driving transistor that controls a current flowing through an organic light emitting diode.

However, due to hysteresis characteristics of the driving transistor, a current flowing through the organic light emitting diode (i.e., a current controlled by the driving transistor) may be influenced by a data voltage of a previous frame. As a result, a non-uniform luminance may be caused among the pixel circuits, even when the same data voltage is applied to the pixel circuits.

Generally, each threshold voltage of driving transistors in the OLED device may be compensated in order to improve luminance uniformity. However, threshold voltage compensation may be insufficiently achieved within a short data programming time period if a data programming operation and a threshold voltage compensating operation for the driving transistors are performed at the same time.

SUMMARY OF THE INVENTION

The present invention provides a pixel circuit capable of preventing a non-uniform luminance due to hysteresis characteristics of driving transistors (i.e., improving luminance uniformity) by separately performing a threshold voltage compensating operation and a data programming operation for the driving transistors, and by applying the same initial value to gate electrodes of the driving transistors prior to the data programming operation.

The present invention also provides a method of driving a pixel circuit capable of preventing a non-uniform luminance due to hysteresis characteristics of driving transistors.

The present invention further provides an organic light emitting display (OLED) device having a pixel circuit capable of preventing non-uniform luminance due to hysteresis characteristics of driving transistors.

According to some example embodiments, a method of driving a pixel circuit may include a step of initializing a driving transistor and a storage capacitor by simultaneously applying an initialization voltage and a first power voltage to a gate electrode of the driving transistor and the storage capacitor, respectively, a step of diode-coupling the driving transistor, a step of applying a data voltage to the storage capacitor, a step of applying the data voltage to the gate electrode of the driving transistor by a coupling of a compensation capacitor coupled between the gate electrode of the driving transistor and the storage capacitor, and a step of applying a current corresponding to the first power voltage and the data voltage to an organic light emitting diode that is coupled to the driving transistor.

In example embodiments, a voltage of the gate electrode of the driving transistor may be changed to a voltage corresponding to the initialization voltage, and a data voltage of a previous frame stored in the storage capacitor may be changed to a voltage corresponding to the first power voltage when the driving transistor and the storage capacitor are initialized.

In example embodiments, a voltage corresponding to a difference between the first power voltage and a threshold voltage of the driving transistor may be applied to the gate electrode of the driving transistor when the driving transistor is diode-coupled.

In example embodiments, the first power voltage stored in the storage capacitor may be changed to the data voltage, and the voltage of the gate electrode of the driving transistor may be reduced by a difference between the first power voltage and the data voltage when the data voltage is applied to the storage capacitor.

In example embodiments, the data voltage may be applied to the storage capacitor when the driving transistor stops being diode-coupled.

According to some example embodiments, a pixel circuit may include an organic light emitting diode, a driving transistor having a gate electrode coupled to a first node, a first electrode for receiving a first power voltage and a second electrode coupled to the organic light emitting diode, a first transistor coupled to the first node, the first transistor providing an initialization voltage to the gate electrode of the driving transistor in response to a reset signal, a second transistor coupled between the second electrode of the driving transistor and the first node, a compensation capacitor having a first electrode coupled to the first node and a second electrode coupled to a second node, a storage capacitor having a first electrode coupled to the second node and a second electrode for receiving the first power voltage, a third transistor coupled to the second node, the third transistor providing the first power voltage to the first electrode of the storage capacitor in response to a reference voltage control signal, a fourth transistor coupled to the second node, the fourth transistor providing a data voltage to the first electrode of the storage capacitor in response to a scan signal, and a light emitting control transistor coupled between the second electrode of the driving transistor and the organic light emitting diode, the light emitting control transistor turning-on in response to a light emitting control signal.

In example embodiments, the driving transistor, the light emitting control transistor, and the first through fourth transistors may be implemented by p-channel metal oxide semiconductor (PMOS) transistors.

In example embodiments, the reference voltage control signal and the reset signal may be simultaneously applied.

In example embodiments, as first through (n)th scan signals, where n is an integer greater than or equal to 3, are sequentially provided, the scan signal may correspond to the (n)th scan signal, the reset signal may correspond to the (n−2)th scan signal, and the (n−1)th scan signal may be applied to the gate electrode of the second transistor.

In example embodiments, as first through (n)th scan signals, where n is an integer greater than or equal to 3, are sequentially provided, the scan signal may correspond to the (n)th scan signal, the reset signal may correspond to one of the first through (n−1)th scan signals, and a compensation control signal may be applied to the gate electrode of the second transistor.

In example embodiments, the length of a period during which the compensation control signal is applied may be determined based on a time point at which the reset signal is applied.

In example embodiments, the compensation control signal may be applied when the reset signal stops being applied.

In example embodiments, the driving transistor may be diode-coupled, and a voltage corresponding to a difference between the first power voltage and a threshold voltage of the driving transistor may be applied to the gate electrode of the driving transistor while the compensation control signal is applied.

In example embodiments, the scan signal may be applied when the compensation control signal stops being applied.

According to some example embodiments, an organic light emitting display (OLED) device may include a display panel having a plurality of pixel circuits, the display panel receiving a first power voltage and a second power voltage, a scan driver that sequentially provides first through (n)th scan signals to the pixel circuits via first through (n)th scan-lines, where n is an integer greater than or equal to 3, a data driver that provides a data voltage to the pixel circuits via a plurality of data-lines based on the first through (n)th scan signals, an emission driver that provides a light emitting control signal to the pixel circuits via a plurality of light emitting control-lines, and a timing controller that controls the scan driver, the data driver and the emission driver. Each of the pixel circuits may include an organic light emitting diode, a driving transistor having a gate electrode coupled to a first node, a first electrode for receiving the first power voltage and a second electrode coupled to the organic light emitting diode, a first transistor coupled to the first node, the first transistor providing an initialization voltage to the gate electrode of the driving transistor in response to one of the first through (n−1)th scan signals, a second transistor coupled between the second electrode of the driving transistor and the first node, a compensation capacitor having a first electrode coupled to the first node and a second electrode coupled to a second node, a storage capacitor having a first electrode coupled to the second node and a second electrode for receiving the first power voltage, a third transistor coupled to the second node, the third transistor providing the first power voltage to the first electrode of the storage capacitor in response to a reference voltage control signal, a fourth transistor coupled to the second node, the fourth transistor providing a data voltage to the first electrode of the storage capacitor in response to the (n)th scan signal, and a light emitting control transistor coupled between the second electrode of the driving transistor and the organic light emitting diode, the light emitting control transistor turning-on in response to the light emitting control signal.

In example embodiments, the (n−2)th scan signal may be applied to the gate electrode of the first transistor, and the (n−1)th scan signal may be applied to the gate electrode of the second transistor.

In example embodiments, the reference voltage control signal and the (n−2)th scan signal may be simultaneously applied.

In example embodiments, the OLED device may further include a compensation controller that provides a compensation control signal to the gate electrode of the second transistor.

In example embodiments, the length of a period during which the compensation control signal is applied may be determined based on a time point at which one of the first through (n−1)th scan signals is applied to the gate electrode of the first transistor.

In example embodiments, the (n)th scan signal may be applied when the compensation control signal stops being applied.

Therefore, a pixel circuit, a method of driving the pixel circuit, and an OLED device according to example embodiments may obtain a sufficient threshold voltage compensation time period regardless of a data programming time period by separately performing a threshold voltage compensating operation and a data programming operation for driving transistors. As a result, the contrast ratio may be improved, and the data programming operation may be performed at high speed. In addition, a non-uniform luminance due to hysteresis characteristics of driving transistors may be prevented (i.e., luminance uniformity may be improved) by applying the same initial value to gate electrodes of the driving transistors prior to the data programming operation.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
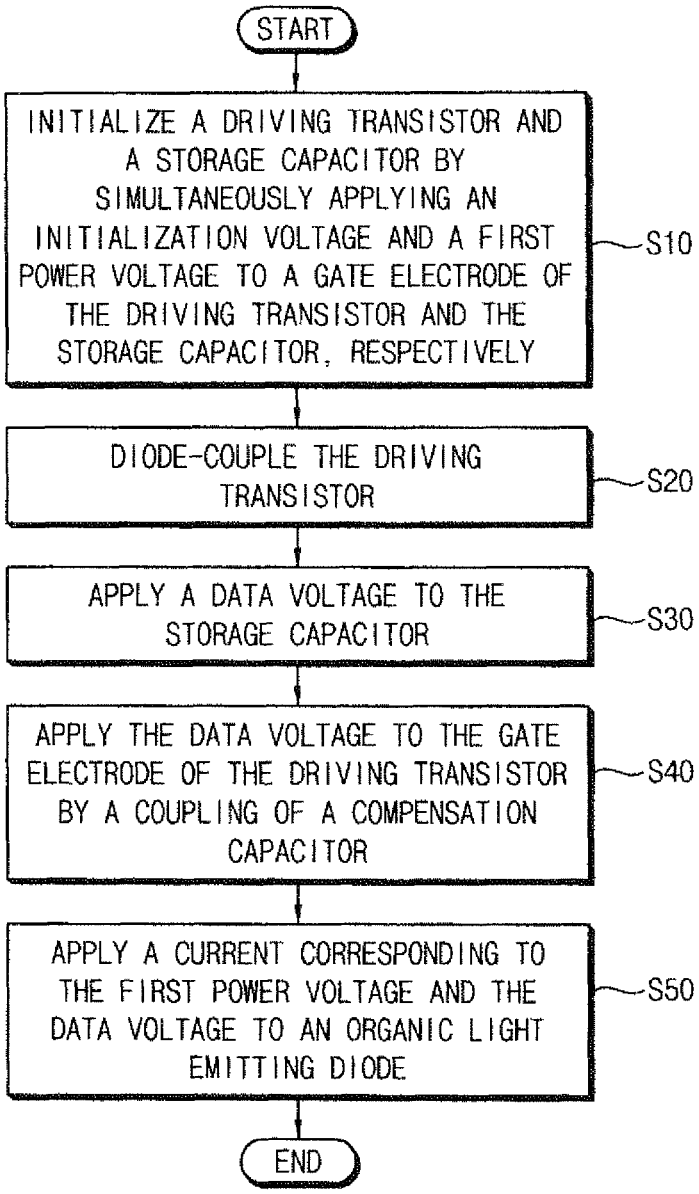
FIG. 1 is a flow chart illustrating a method of driving a pixel circuit according to example embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present invention. As used herein, the term "and/or" includes any and all combinations of one or more of the associated listed items.

It will be understood that, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a flow chart illustrating a method of driving a pixel circuit according to example embodiments.

Referring to FIG. 1, a driving transistor and a storage capacitor may be initialized (Step S10) by simultaneously applying an initialization voltage and a first power voltage to a gate electrode of the driving transistor and the storage capacitor, respectively, when a current frame begins. Thus, a voltage of the gate electrode of the driving transistor may be changed to a voltage corresponding to the initialization voltage, and a data voltage of a previous frame stored in the storage capacitor may be changed to a voltage corresponding to the first power voltage. In example embodiments, the first power voltage applied to the storage capacitor may be used as a reference voltage for initializing the storage capacitor. According to example embodiments, since the first power voltage is used as the reference voltage (i.e., without applying additional reference voltages), the circuit structure may be simplified and a current flowing through an organic light emitting diode may be easily controlled. The current flowing through the organic light emitting diode may be described in detail with reference to FIG. 4E.

According to example embodiments, the initialization voltage and the first power voltage may be simultaneously applied to the gate electrode of the driving transistor and the storage capacitor, respectively. Thus, the driving transistor and the storage capacitor may be fully initialized, respectively. For example, if the initialization voltage is applied to the gate electrode of the driving transistor, and then the first power voltage is applied to the storage capacitor, the voltage of the gate electrode of the driving transistor may be changed (i.e., may fluctuate) due to a coupling of a compensation capacitor coupled between the gate electrode of the driving transistor and the storage capacitor. As a result, a non-uniform luminance may be caused because the voltage of the gate electrode of the driving transistor is not initialized to a specific value.

In example embodiments, the driving transistor may be a p-channel metal oxide semiconductor (PMOS) transistor. In example embodiments, the initialization voltage may be a low voltage by which the driving transistor can be turned-on. As a result, the driving transistor may be easily diode-coupled in the next phase.

The driving transistor may be diode-coupled (Step S20). Hence, a voltage corresponding to a difference between the first power voltage and the threshold voltage of the driving transistor may be applied to the gate electrode of the driving transistor. That is, in every frame, all gate electrodes of all driving transistors included in a display panel may be initialized to a voltage corresponding to a difference between the first power voltage and each threshold voltage of the driving transistors. Therefore, hysteresis characteristics due to deviations among voltages of the gate electrodes of the driving transistors may be eliminated because the driving transistors are programmed from the same voltage to each data voltage. As a result, luminance uniformity may be improved.

Then, a data voltage may be applied to the storage capacitor (Step S30). Hence, the voltage of the storage capacitor may be changed from the first power voltage to the data voltage. As the voltage of the storage capacitor is changed from the first power voltage to the data voltage, the data voltage may be applied to the gate electrode of the driving transistor (Step S40) by a coupling of the compensation capacitor coupled between the gate electrode of the driving transistor and the storage capacitor. In detail, a variation corresponding to the difference between the first power voltage and the data voltage may be applied to the gate electrode of the driving transistor. As described above, in the method of FIG. 1, a data voltage is not directly applied to the gate electrode of the driving transistor. Instead, the data voltage is applied to the gate electrode of the driving transistor by a coupling of the compensation capacitor. That is, a threshold voltage compensating operation and a data programming operation for the driving transistor are spatially/temporally separated. Hence, a sufficient threshold voltage compensation time period may be obtained regardless of the data programming time period. As a result, the contrast ratio may be improved, and the data programming operation may be performed at high speed.

Next, a current corresponding to the first power voltage and the data voltage may be applied to an organic light emitting diode coupled to the driving transistor (Step S50). This operation may be performed by turning-on a light emitting control transistor coupled between the driving transistor and the organic light emitting diode. The current may be proportional to the square of the difference between the first power voltage and the data voltage. As described above, the current flowing through the organic light emitting diode does not include threshold voltage components of the driving transistor, so that a non-uniform luminance due to threshold voltage deviations of driving transistors may be prevented. The method of FIG. 1 will be described in detail below with reference to FIGS. 4A through 4E.

Figure 2:
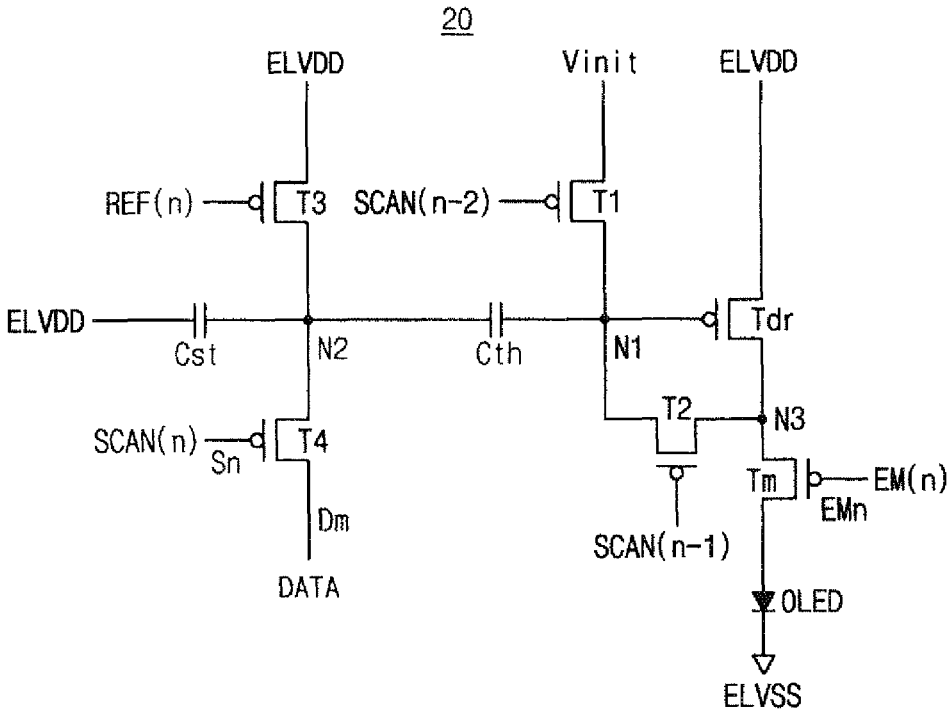
FIG. 2 is a circuit diagram illustrating an example of a pixel circuit that is driven by the method of FIG. 1.

FIG. 2 is a circuit diagram illustrating an example of the pixel circuit that is driven by the method of FIG. 1.

Referring to FIG. 2, the pixel circuit 20 may be placed at a crossing point of a data-line Dm and a scan-line Sn. The pixel circuit 20 may receive a first power voltage ELVDD and a second power voltage ELVSS. The pixel circuit 20 may include an organic light emitting diode OLED, a driving transistor Tdr, first through fourth transistors T1 through T4, a light emitting control transistor Tm, a compensation capacitor Cth, and a storage capacitor Cst.

The driving transistor Tdr may include a gate electrode coupled to a first node N1, a first electrode for receiving the first power voltage ELVDD, and a second electrode coupled to the organic light emitting diode OLED. The first transistor T1 may be coupled to the first node N1, and may provide an initialization voltage Vinit to the gate electrode of the driving transistor Tdr in response to a reset signal. The second transistor T2 may be coupled between the second electrode of the driving transistor Tdr and the first node N1. The storage capacitor Cth may include a first electrode coupled to the first node N1 and a second electrode coupled to a second node N2. The storage capacitor Cst may include a first electrode coupled to the second node N2, and a second electrode for receiving the first power voltage ELVDD. The third transistor T3 may be coupled to the second node N2, and may provide the first power voltage ELVDD to the first electrode of the storage capacitor Cst in response to a reference voltage control signal REF(n). The fourth transistor T4 may be coupled to the second node N2, and may provide a data voltage DATA to the first electrode of the storage capacitor Cst in response to a scan signal SCAN (n). The light emitting control transistor Tm may be coupled between the second electrode of the driving transistor Tdr and the organic light emitting diode OLED, and may turn-on in response to a light emitting control signal EM(n).

In example embodiments, the pixel circuit 20 may be implemented by a plurality of PMOS transistors. That is, the driving transistor Tdr, the first through fourth transistors T1 through T4, and the light emitting control transistor Tm may be implemented by PMOS transistors. As a result, the PMOS transistors may turn-on when signals having a logic low level are applied to gate electrodes of the PMOS transistors. On the other hand, the PMOS transistors may turn-off when signals having a logic high level are applied to gate electrodes of the PMOS transistors.

In the pixel circuit 20, the reference voltage control signal REF(n) and the reset signal may be applied at the same time. Therefore, the first power voltage ELVDD and the initialization voltage Vinit may be simultaneously applied to the storage capacitor Cst and the gate electrode of the driving transistor Tdr, respectively.

In one example embodiment, when first through (n)th scan signals are sequentially applied to a plurality of pixel circuits 20, where n is an integer greater than or equal to 3, the scan signal may correspond to the (n)th scan signal SCAN(n), the reset signal may correspond to the (n−2)th scan signal SCAN (n−2), and the (n−1)th scan signal SCAN(n−1) may be applied to the gate electrode of the second transistor T2. Hence, the first transistor T1, the second transistor T2 and the fourth transistor T4 may sequentially turn-on, and may sequentially perform respective operations.

In another example embodiment, when first through (n)th scan signals are sequentially applied to a plurality of pixel circuits 20, where n is an integer greater than or equal to 3, the scan signal may correspond to the (n)th scan signal SCAN(n), the reset signal may correspond to one of the first through (n−1)th scan signals SCAN(1) through SCAN(n−1), and a compensation control signal may be applied to the gate electrode of the second transistor T2. The compensation control signal will be described below with reference to FIG. 5. In addition, the compensation control signal may be applied when the reset signal stops being applied. Furthermore, the scan signal SCAN(n) may be applied when the compensation control signal stops being applied. Hence, the first transistor T1, the second transistor T2 and the fourth transistor T4 may sequentially turn-on, and may sequentially perform respective operations.

In example embodiments, the length of a period during which the compensation control signal is applied may be determined based on a time point at which the reset signal is applied. For example, if the (n−4)th scan signal is applied as the reset signal, the compensation control signal may be applied during a period, the length of which is three times greater than a length of a logic low level period of the scan signal.

Figure 3:
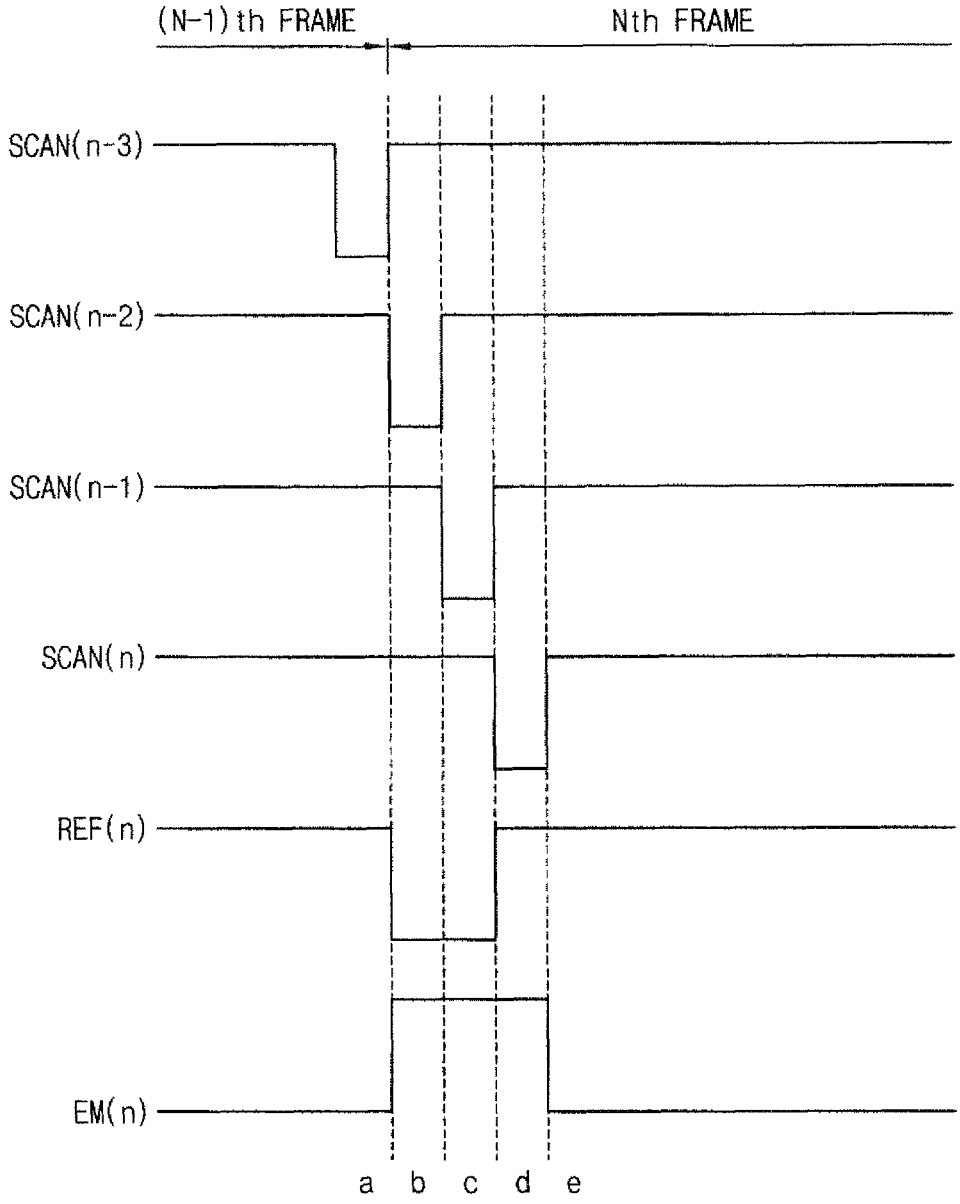
FIG. 3 is a timing diagram illustrating that the pixel circuit of FIG. 2 is driven by the method of FIG. 1.

FIG. 3 is a timing diagram illustrating that the pixel circuit of FIG. 2 is driven by the method of FIG. 1.

Referring to FIG. 3, an 'a' period may be related to an (N−1)th frame (i.e., a previous frame). In addition, 'b' through 'e' periods may be related to an (N)th frame (i.e., a current frame). That is, each frame (i.e., a current frame) for driving a pixel circuit may include 'b' through 'e' periods. Here, the 'b' through 'd' periods may be referred to as non-light emitting period, and the 'e' period may be referred to as a light emitting period.

Referring to FIGS. 2 and 3, when the (N)th frame begins, the (n−2)th scan signal SCAN(n−2) may be applied to the first transistor T1, and the reference voltage control signal REF(n) may be applied to the third transistor T3 at the same time (i.e., the 'b' period). Then, the (n−1)th scan signal SCAN(n−1) may be applied to the second transistor T2 (i.e., the 'c' period). Then, the (n)th scan signal SCAN(n) may be applied to the fourth transistor T4 when the reference voltage control signal REF(n) stops being applied (i.e., the 'd' period). Then, after a data programming operation is finished, the organic light emitting diode OLED may emit a light (i.e., the 'e' period) when the light emitting control signal EM(n) is changed from a logic high level to a logic low level.

FIGS. 4A through 4J are diagrams illustrating that the pixel circuit of FIG. 2 is driven by the method of FIG. 1. Hereinafter, the method of FIG. 1 will be described based on each period with reference to FIGS. 4A through 4J.

Figure 4A:
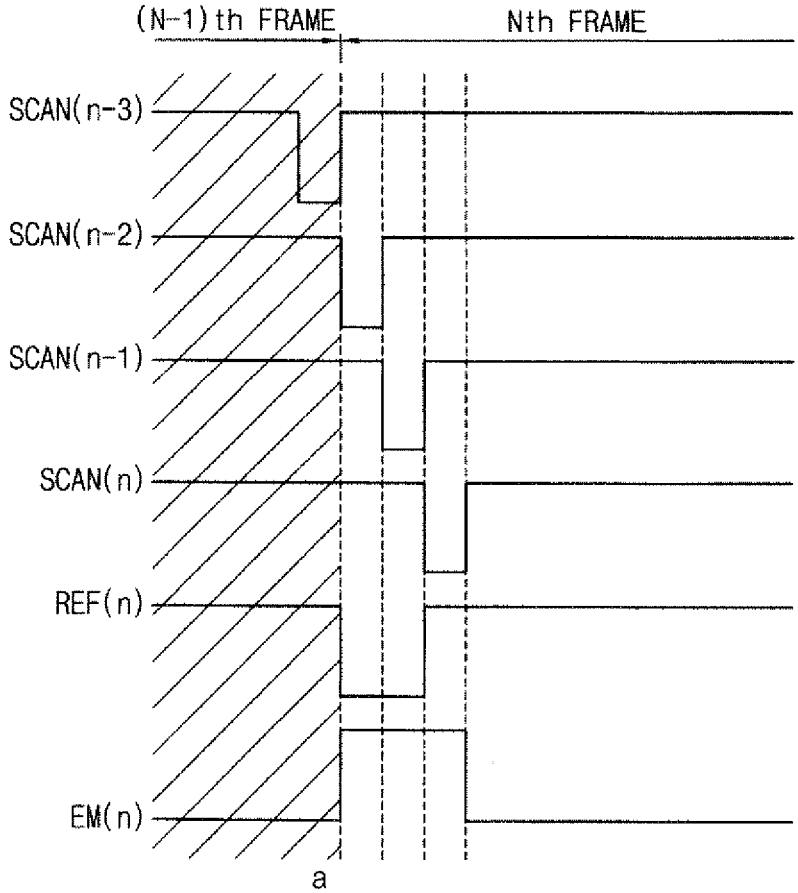
FIGS. 4A through 4J are diagrams illustrating that the pixel circuit of FIG. 2 is driven by the method of FIG. 1.
Figure 4B:
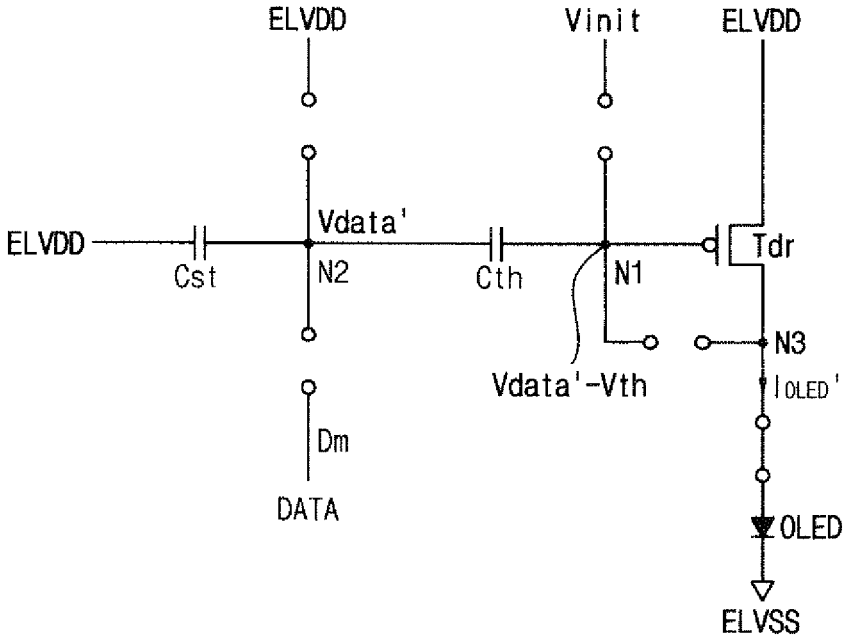

Referring to FIGS. 4A and 4B, the first period (i.e., the 'a' period) may be related to the (N−1)th frame. Since the light emitting control signal EM(n) having a logic low level is applied, the organic light emitting diode OLED may emit light based on an organic light emitting diode current IOLED' corresponding to a data voltage Vdata' of the (N−1)th frame. Here, the (N)th frame does not begin yet. In addition, the (n−2)th scan signal SCAN(n−2), the (n−1)th scan signal SCAN(n−1), the (n)th scan signal SCAN(n), and the reference voltage control signal REF(n) may each have a logic high level. Thus, the transistors receiving the (n−2)th scan signal SCAN(n−2), the (n−1)th scan signal SCAN(n−1), the (n)th scan signal SCAN(n), and the reference voltage control signal REF(n) may be in a turned-off state.

Figure 4C:
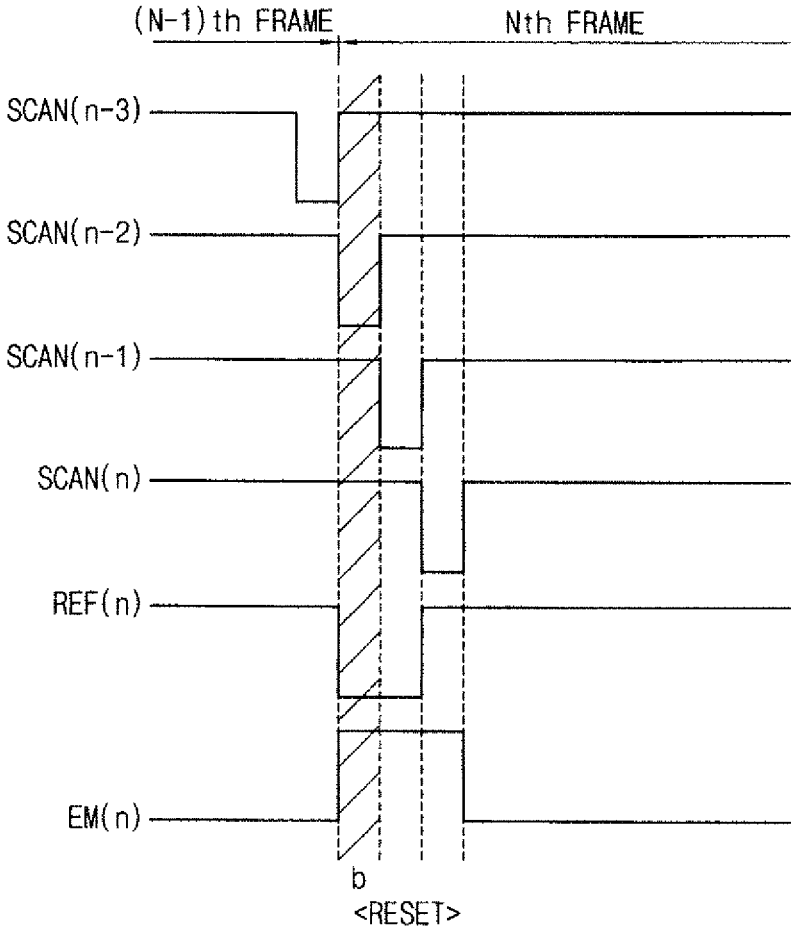
Figure 4D:
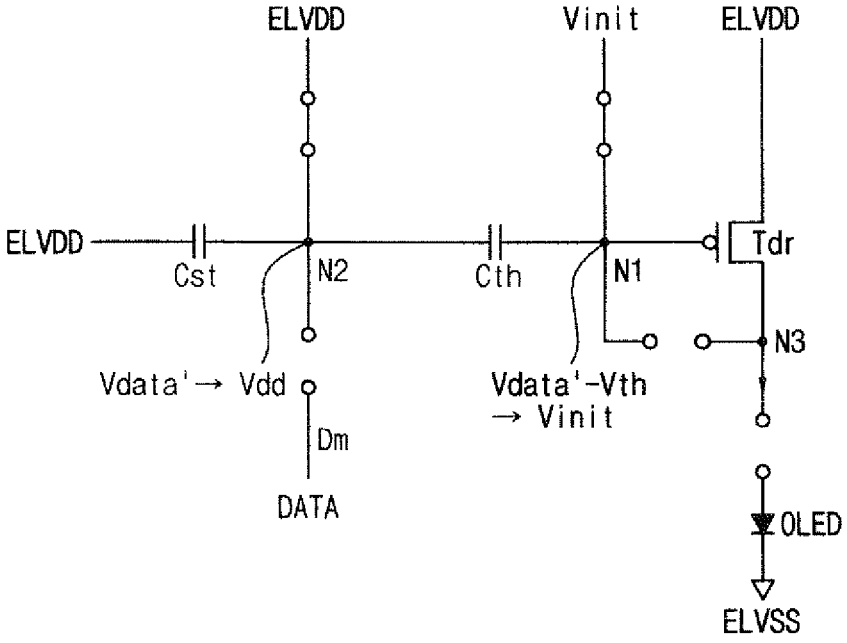

Referring to FIGS. 4C and 4D, the second period (i.e., the 'b' period) may be related to a reset phase RESET. In the second period (i.e., the 'b' period), the (n−2)th scan signal SCAN(n−2) having a logic low level may be provided to the first transistor T1, and the reference voltage control signal REF(n) having a logic low level may be provided to the third transistor T3. Thus, the initialization voltage Vinit may be applied to the gate electrode of the driving transistor Tdr (i.e., the first node N1), and the first power voltage Vdd may be applied to the storage capacitor Cst (i.e., the second node N2) as a reference voltage. In other words, the voltage of the first node N1 may be changed from a voltage corresponding to a difference between the data voltage Vdata' of the (N−1)th frame (i.e., the previous frame) and a threshold voltage Vth of the driving transistor Tdr to the initialization voltage Vinit. In addition, the voltage of the second node N2 may be changed from the data voltage Vdata' of the (N−1)th frame (i.e., the previous frame) to the first power voltage Vdd. Thus, the first node N1 and the second node N2 may be initialized. These operations may be expressed as set forth below.

$$V_{N1}=V\text{data}'-V\text{th}=>V\text{init} \quad \text{Expression 1}$$

(Here, $V_{N1}$ denotes a voltage of the first node N1.)

$$V_{N2}=V\text{data}'=>Vdd \quad \text{Expression 2}$$

(Here, VN2 denotes a voltage of the second node N2)

As described above, according to the method of FIG. 1, the first power voltage Vdd may be used as the reference voltage without applying additional reference voltages. Hence, the circuit structure may be simplified, and a current flowing through the organic light emitting diode OLED may be easily controlled. In addition, the gate electrode of the driving transistor Tdr and the storage capacitor Cst may be fully initialized because the initialization voltage Vinit and the first power voltage Vdd are simultaneously applied to the gate electrode of the driving transistor Tdr and the storage capacitor Cst, respectively. As a result, luminance uniformity may be improved.

In example embodiments, the initialization voltage Vinit may be a low voltage by means of which the driving transistor Tdr can be turned-on. Thus, in a next phase (i.e., the 'c' period), the driving transistor Tdr may be easily diode-coupled.

Figure 4E:
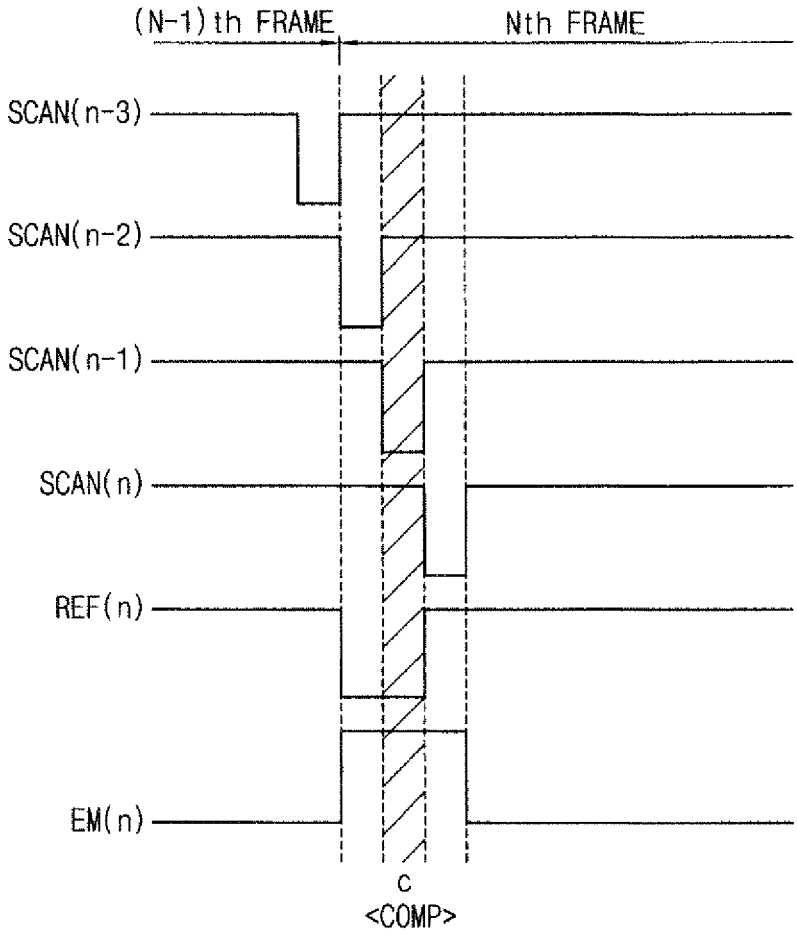
Figure 4F:
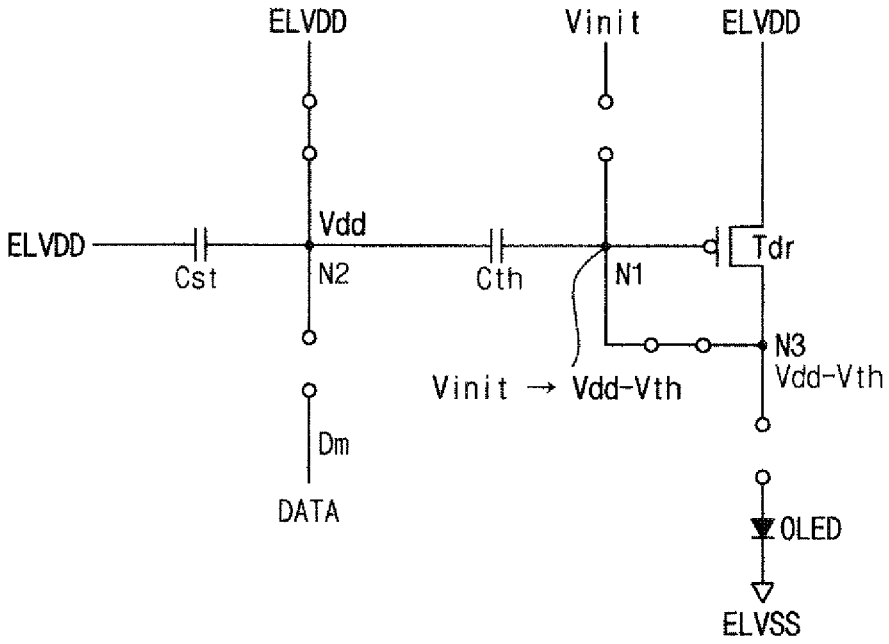

Referring to FIGS. 4E and 4F, the third period (i.e., the 'c' period) may be related to a compensation phase COMP. In the third period (i.e., the 'c' period), the (n−1)th scan signal SCAN(n−1) having a logic low level may be provided to the second transistor T2. As a result, the driving transistor Tdr may be diode-coupled because the second transistor T2 turns-on. Here, a voltage corresponding to the difference between the first power voltage Vdd and the threshold voltage Vth of the driving transistor Tdr may be applied to the third node N3 and the first node N1 coupled to the third node N3. These operations may be expressed as set forth below.

$$V_{N1}=V\text{init}=>Vdd-V\text{th} \quad \text{Expression 3}$$

(Here, $V_{N1}$ denotes a voltage of the first node N1.)

As described above, in every frame, all gate electrodes of all driving transistors Tdr included in a display panel may be initialized to a voltage corresponding to the difference between the first power voltage Vdd and each threshold voltage Vth of the driving transistors Tdr. Thus, the gate electrode of the driving transistor Tdr may be programmed from the same voltage to a data voltage Vdata of one frame (i.e., the current frame). Hence, hysteresis characteristics due to deviations among voltages of gate electrodes of the driving transistors Tdr may be eliminated, and luminance uniformity may be improved.

Figure 4G:
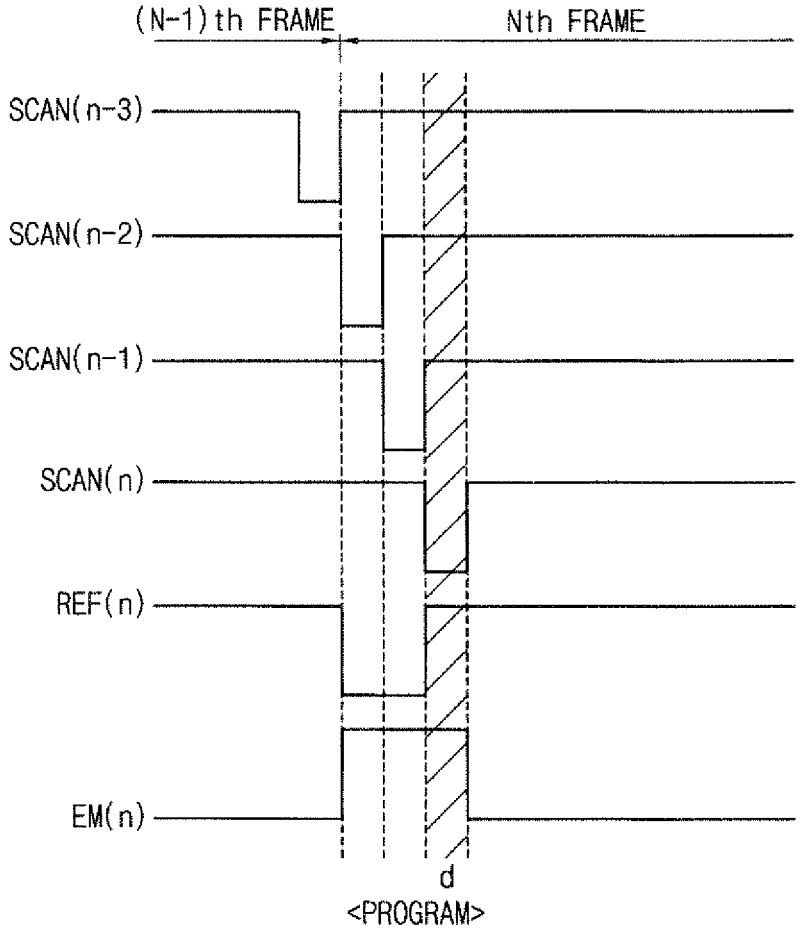
Figure 4H:
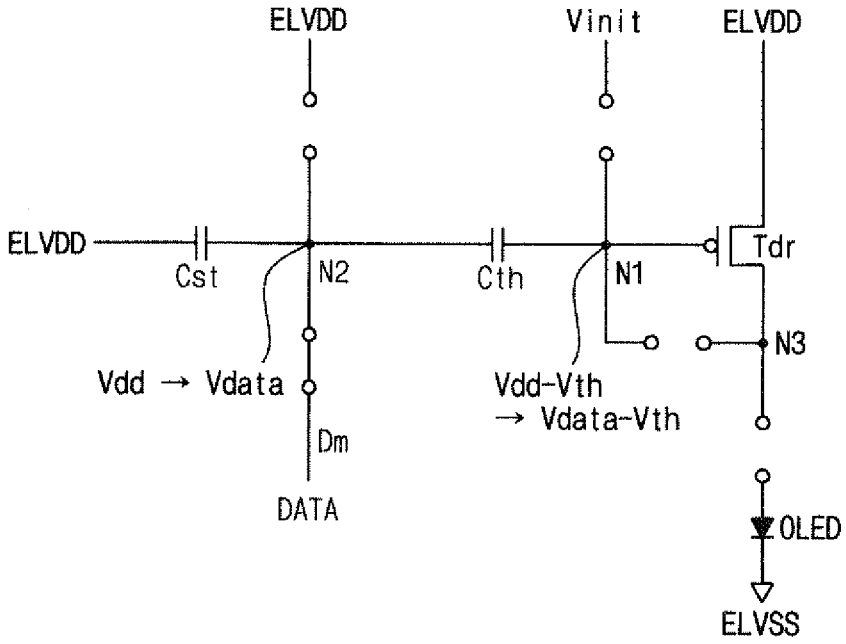

Referring to FIGS. 4G and 4H, the fourth period (i.e., the 'd' period) may be related to a program phase PROGRAM. In the fourth period (i.e., the 'd' period), the (n)th scan signal SCAN(n) having a logic low level may be provided to the fourth transistor T4. As a result, a data voltage Vdata of the (N)th frame may be applied to the second node N2 through the data-line Dm because the fourth transistor T4 turns-on. In other words, the storage capacitor Cst may be programmed to store the data voltage Vdata. Here, by a coupling of the compensation capacitor Cth coupled between the first node N1 and the second node N2, the voltage of the first node N1 may be changed by a variation of the voltage of the second node N2. That is, the voltage of the gate electrode of the driving transistor Tdr may be reduced by the difference between the first power voltage Vdd and the data voltage Vdata. These operations may be expressed as set forth below.

$$V_{N2}=Vdd=>V\text{data} \quad \text{Expression 4}$$

(Here, $V_{N2}$ denotes a voltage of the second node N2.)

$$V_{N1}=Vdd-V\text{th}=>Vdd-V\text{th}-(Vdd-V\text{data})=>V\text{data}-V\text{th} \quad \text{Expression 5}$$

(Here, $V_{N1}$ denotes a voltage of the first node N1.)

As described above, according to the method of FIG. 1, the data voltage Vdata may be indirectly provided to the gate electrode of the driving transistor Tdr. That is, the data voltage Vdata may be provided to the gate electrode of the driving transistor Tdr by a coupling of the compensation capacitor Cth. Hence, a threshold voltage compensating operation and a data programming operation for the driving transistor are spatially/temporally separated. Thus, a sufficient threshold voltage compensation time period may be obtained regardless of the data programming time period. As a result, the contrast ratio may be improved, and the data programming operation may be performed at high speed.

Figure 4I:
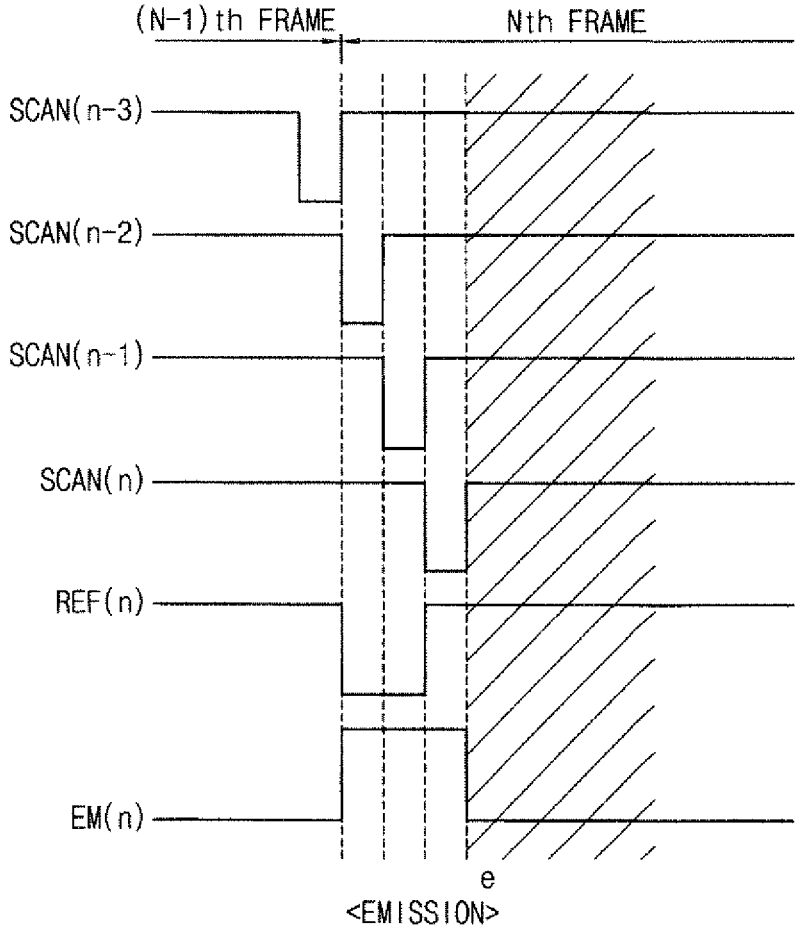
Figure 4J:
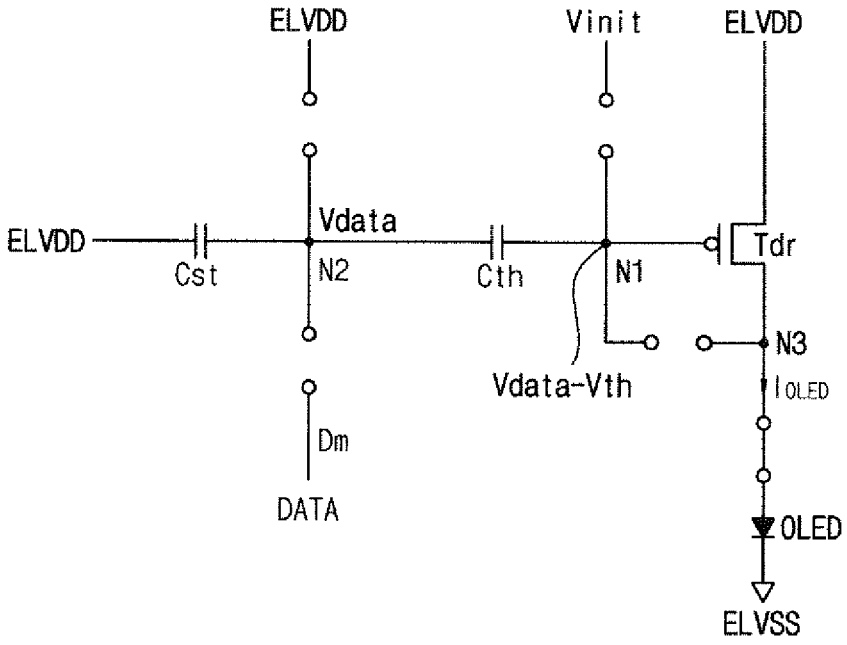

Referring to FIGS. 4I and 4J, the fifth period (i.e., the 'e' period) may be related to an emission phase EMISSION. In the fifth period (i.e., the 'e' period), the light emitting control signal EM(n) having a logic low level may be provided to the light emitting control transistor Tm. As a result, the light emitting control transistor Tm may be coupled, and thus the organic light emitting diode OLED may emit light because an organic light emitting diode current IOLED flows through the organic light emitting diode OLED. Here, the organic light emitting diode current IOLED may include components of a voltage of the first node N1. As described above, since the voltage of the first node N1 includes threshold voltage components of the driving transistor Tdr in the program phase PROGRAM, the organic light emitting diode current IOLED may have a value without the threshold voltage components of the driving transistor Tdr. These operations may be expressed as set forth below.

$$Vs=Vdd \quad \text{Expression 6}$$

(Here, Vs denotes a voltage of the source electrode of the driving transistor Tdr.)

$$Vg=V\text{data}-V\text{th} \quad \text{Expression 7}$$

(Here, Vg denotes a voltage of the gate electrode of the driving transistor Tdr.)

$$Vsg=Vdd-(V\text{data}-V\text{th})=Vdd-V\text{data}+V\text{th} \quad \text{Expression 8}$$

$$\therefore \text{IOLED}=\tfrac{1}{2}*k*(Vsg-V\text{th})\hat{}2=\tfrac{1}{2}*k*(Vdd-V\text{data})\hat{}2 \quad \text{Expression 9}$$

(Here, k denotes a constant determined based on the driving transistor Tdr.)

As shown in Expression 9, it should be understood that the threshold voltage components of the driving transistor Tdr are eliminated. In addition, it should be understood that the magnitude of the organic light emitting diode current IOLED is proportional to the square of the difference between the first power voltage Vdd and the data voltage Vdata. Hence, deviations among a plurality of pixel circuits included in a display panel may be eliminated because the organic light emitting diode OLED may allow an organic light emitting diode current IOLED (i.e., irrelevant to the threshold voltage Vth of the driving transistor Tdr) to pass through.

Figure 5:
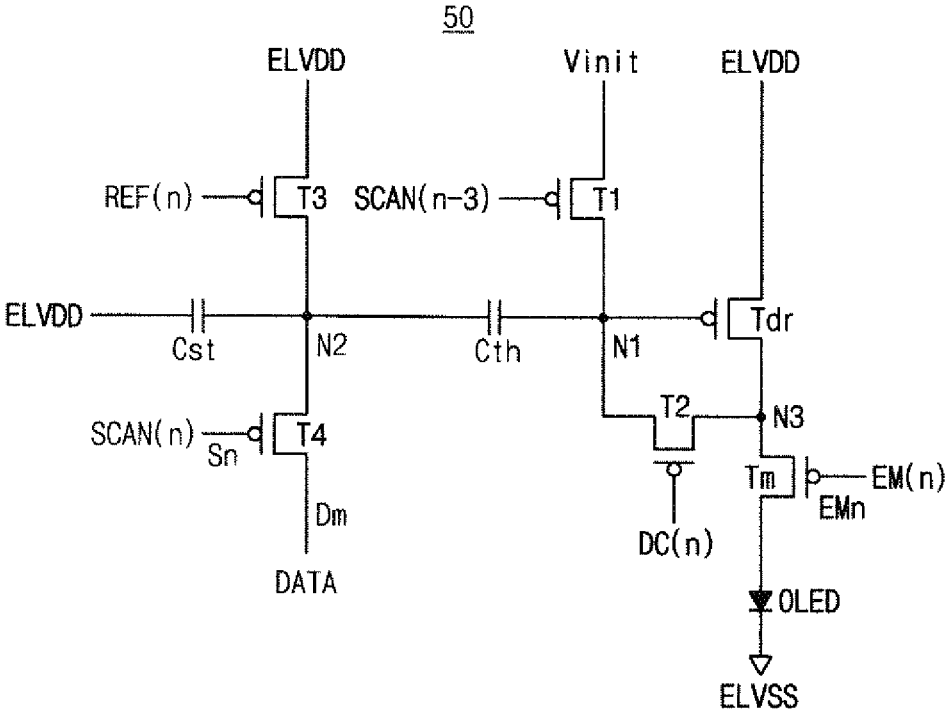
FIG. 5 is a circuit diagram illustrating another example of a pixel circuit that is driven by the method of FIG. 1.
Figure 6:
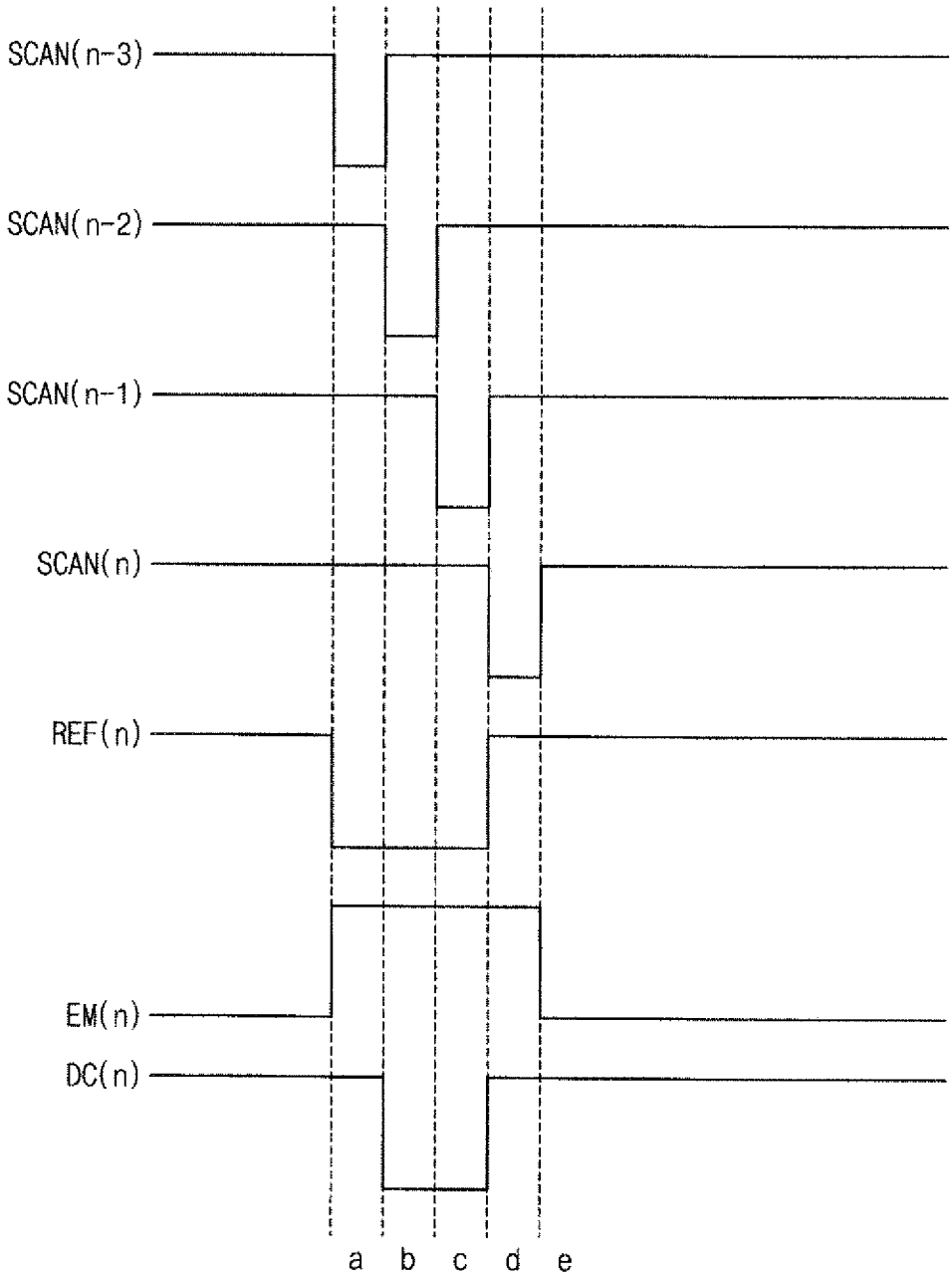
FIG. 6 is a timing diagram illustrating that the pixel circuit of FIG. 5 is driven by the method of FIG. 1.

FIG. 5 is a circuit diagram illustrating another example of a pixel circuit that is driven by the method of FIG. 1, and FIG.

6 is a timing diagram illustrating that the pixel circuit of FIG. 5 is driven by the method of FIG. 1.

Referring to FIG. 5, except for signals applied to gate electrodes of first and second transistors T1 and T2, the pixel circuit 50 of FIG. 5 may have the same structure as the pixel circuit 20 of FIG. 2. Hereinafter, focused on the difference between the pixel circuit 20 of FIG. 2 and the pixel circuit 50 of FIG. 5, the method of FIG. 1 will be described below.

In a first period (i.e., the 'a' period), an (n−3)th scan signal SCAN(n−3) may be applied to a first transistor T1, and a reference voltage control signal REF(n) may be applied to a third transistor T3. Then, in a second period (i.e., the 'b' period), an (n−2)th scan signal SCAN(n−2) may be applied, and in a third period (i.e., the 'c' period), an (n−1)th scan signal SCAN(n−1) may be applied. Here, it should be understood that the (n−2)th scan signal SCAN(n−2) and the (n−1)th scan signal SCAN(n−1) are applied to other scan-lines that are adjacent to an (n)th scan-line Sn coupled to the scan circuit 50. In other words, the pixel circuit 50 coupled to the (n)th scan-line Sn may turn-on the first transistor T1 using the (n−3)th scan signal SCAN(n−3), and may turn-on a fourth transistor T4 using the (n)th scan signal SCAN(n) that is applied after the (n−2)th scan signal SCAN(n−2) and the (n−1)th scan signal SCAN(n−1). Here, since the (n−3)th scan signal SCAN(n−3) is exemplary, a scan signal related to one of other scan-lines may be applied to the first transistor T1. For example, after an (n−4)th scan signal SCAN(n−4) is applied to the first transistor T1, the (n)th scan signal SCAN (n) may be applied to the fourth transistor T4.

From the second period (i.e., the 'b' period), a compensation control signal DC(n) may be applied to the second transistor T2. Then, the compensation control signal DC(n) may stop being applied to the second transistor T2 before a fourth period (i.e., the 'd' period). That is, the compensation control signal DC(n) may be applied after a signal is applied to the first transistor T1 in the first period (i.e., the 'a' period) but before a signal is applied to the fourth transistor T4 in the fourth period (i.e., the 'd' period). In conclusion, the length of the period during which the compensation control signal DC(n) is applied may be determined based on a time point at which a signal is applied to the first transistor T1 in the first period (i.e., the 'a' period).

In example embodiments, the compensation control signal DC(n) may be a signal that is applied from a compensation controller. That is, the compensation control signal DC(n) may be controlled independently of the scan signals. Hence, the threshold voltage compensation time period for the driving transistor Tdr may be easily (i.e., independently) adjusted. In addition, the data programming operation may be performed within a small time because the data programming operation is performed by a coupling of the compensation capacitor in the fourth period (i.e., the 'd' period). Therefore, the contrast ratio may be improved, and the data programming operation may be performed at high speed.

Figure 7A:
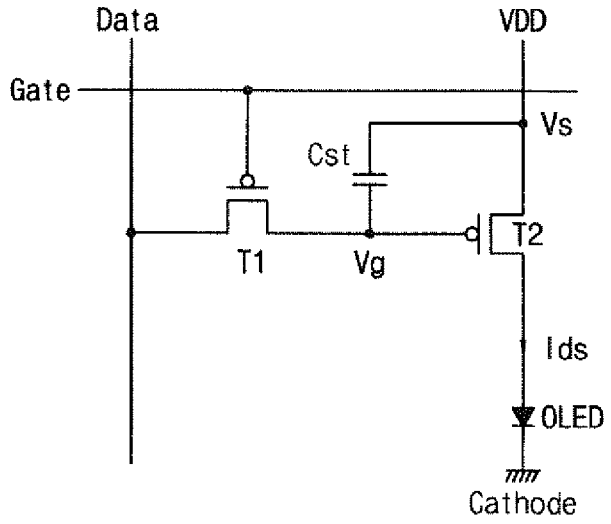
FIGS. 7A and 7B are diagrams illustrating hysteresis characteristics of a p-type polycrystalline silicon thin-film transistor.
Figure 7B:
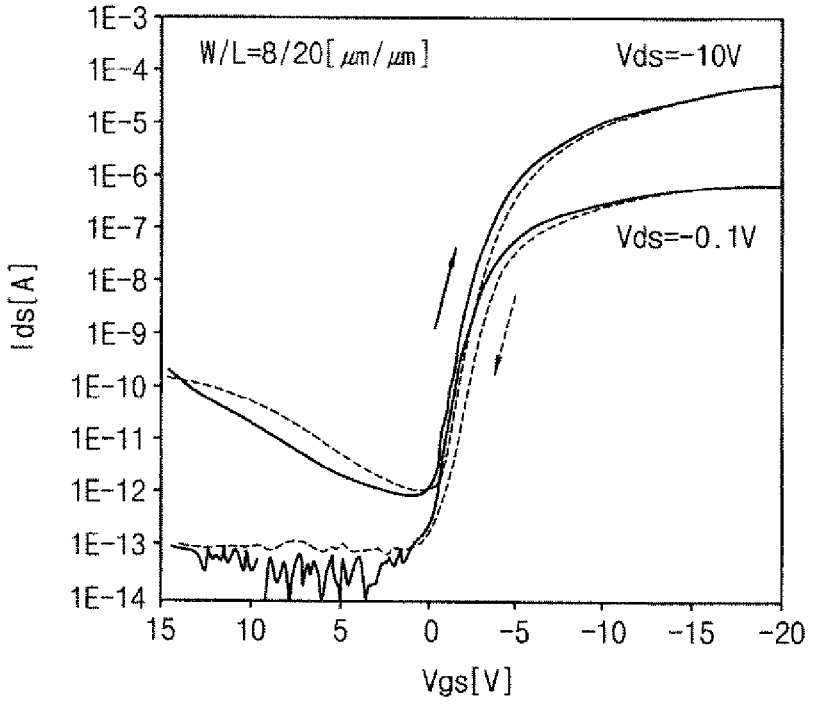

FIGS. 7A and 7B are diagrams illustrating hysteresis characteristics of a p-type polycrystalline silicon thin-film transistor.

Referring to FIG. 7A, a basic pixel circuit of an organic light emitting display (OLED) device having two thin film transistors T1 and T2 and one capacitor Cst is illustrated. The first transistor T1 may provide a data signal Data to a gate electrode of the second transistor T2 in response to a scan signal Gate. Here, the data voltage of a previous frame stored in the gate electrode of the second transistor T2 may influence a current Ids flowing through an organic light emitting diode OLED. Hereinafter, hysteresis characteristics of the p-type polycrystalline silicon thin-film transistor will be described with reference to FIG. 7B.

FIG. 7B shows a measurement result of hysteresis characteristics of the p-type polycrystalline silicon thin-film transistor. It can be recognized that a value of the threshold voltage varies according to a gate sweep direction (i.e., X-axis). Hysteresis characteristics of the p-type polycrystalline silicon thin-film transistor may be caused by a charge-trapping phenomenon between a polycrystalline silicon thin-film and a gate oxide film. Based on a gate voltage Vg, charges may be trapped or detrapped. In addition, if a sweep begins from a negative gate voltage (i.e., decreases on X-axis), holes may be trapped, and thus the threshold voltage and the drain current Ids may be reduced. On the other hand, if a sweep begins from a positive gate voltage (i.e., increases on X-axis), trapped holes may be detrapped, and thus the threshold voltage and the drain current Ids may be increased. Hence, even when the same voltage is applied to the gate electrode of the second transistor T2, the drain current Ids may vary according to a previous gate voltage Vg. Thus, an afterimage may be caused in an organic light emitting display device using the basic pixel circuit structure of FIG. 7A.

Therefore, before applying each data voltage to the gate electrodes of driving transistors in a program phase, it is necessary to initialize the gate electrodes of the driving transistors to the same voltage. If the gate electrodes of the driving transistors are initialized to the same voltage, the drain current Ids may not vary according to the gate sweep directions. Therefore, the present invention may initialize all gate electrodes of all driving transistors to the same voltage by sequentially diode-coupling all driving transistors prior to the data programming operation. As a result, a non-uniform luminance due to hysteresis characteristics of driving transistors may be prevented.

Figure 8:
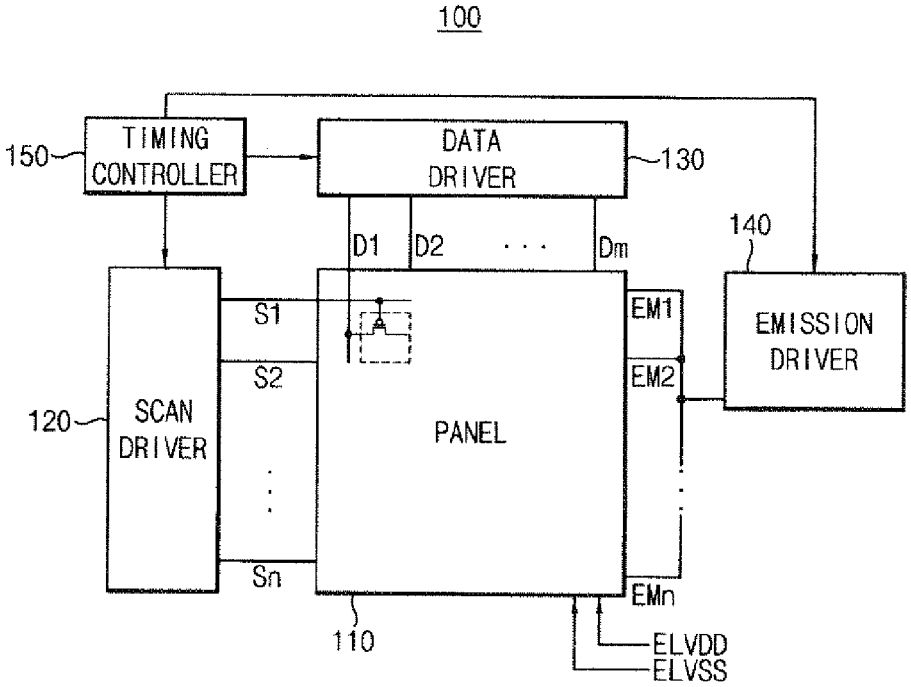
FIG. 8 is a block diagram illustrating an organic light emitting display (OLED) device according to example embodiments.

FIG. 8 is a block diagram illustrating an organic light emitting display (OLED) device according to example embodiments.

Referring to FIG. 8, the organic light emitting display device 100 may include a display panel 110, a scan driver 120, a data driver 130, an emission driver 140, and a timing controller 150.

The display panel 110 may include a plurality of pixel circuits. The display panel 110 may receive a first power voltage ELVDD and a second power voltage ELVSS. The scan driver 120 may sequentially provide first through (n)th scan signals to the pixel circuits via first through (n)th scan-lines S1 through Sn, where n is an integer greater than or equal to 3. Based on the first through (n)th scan signals, the data driver 130 may provide a data voltage to the pixel circuits via a plurality of data-lines D1 through Dm. The emission driver 140 may provide a light emitting control signal to the pixel circuits via a plurality of light emitting control-lines EM1 through EMn. In example embodiments, the emission driver 140 may provide a reference voltage control signal to the pixel circuits via the light emitting control-lines EM1 through EMn. The timing controller 150 may control the scan driver 120, the data driver 130, and the emission driver 140.

In example embodiments, each pixel circuit may include an organic light emitting diode, a driving transistor, first through fourth transistors, a light emitting control transistor, a compensation capacitor, and a storage capacitor.

The driving transistor may include a gate electrode coupled to a first node, a first electrode for receiving the first power voltage ELVDD, and a second electrode coupled to the organic light emitting diode. The first transistor may be coupled to the first node, and may provide an initialization voltage to the gate electrode of the driving transistor in response to one of the first through (n−1)th scan signals. The second transistor may be coupled between the second electrode of the driving transistor and the first node. The compensation capacitor may include a first electrode coupled to the first node and a second electrode coupled to the second node. The storage capacitor may include a first electrode coupled to the second node and a second electrode for receiving the first power voltage ELVDD. The third transistor may be coupled to the second node, and may provide the first power voltage ELVDD to the first electrode of the storage capacitor in response to the reference voltage control signal. The fourth transistor may be coupled to the second node, and may provide a data voltage to the first electrode of the storage capacitor in response to the (n)th scan signal. The light emitting control transistor may be coupled between the second electrode of the driving transistor and the organic light emitting diode, and may turn-on in response to the light emitting control signal.

In example embodiments, the (n−2)th scan signal may be applied to the gate electrode of the first transistor, and the (n−1)th scan signal may be applied to the gate electrode of the second transistor. In addition, the reference voltage control signal and the (n−2)th scan signal may be simultaneously applied. As described above, a sufficient threshold voltage compensation time period may be obtained regardless of a data programming time period by separately performing a threshold voltage compensating operation and a data programming operation for a driving transistor. In addition, a non-uniform luminance due to hysteresis characteristics of the driving transistors may be prevented (i.e., luminance uniformity may be improved) by applying the same initial value to gate electrodes of the driving transistors prior to the data programming operation.

Figure 9:
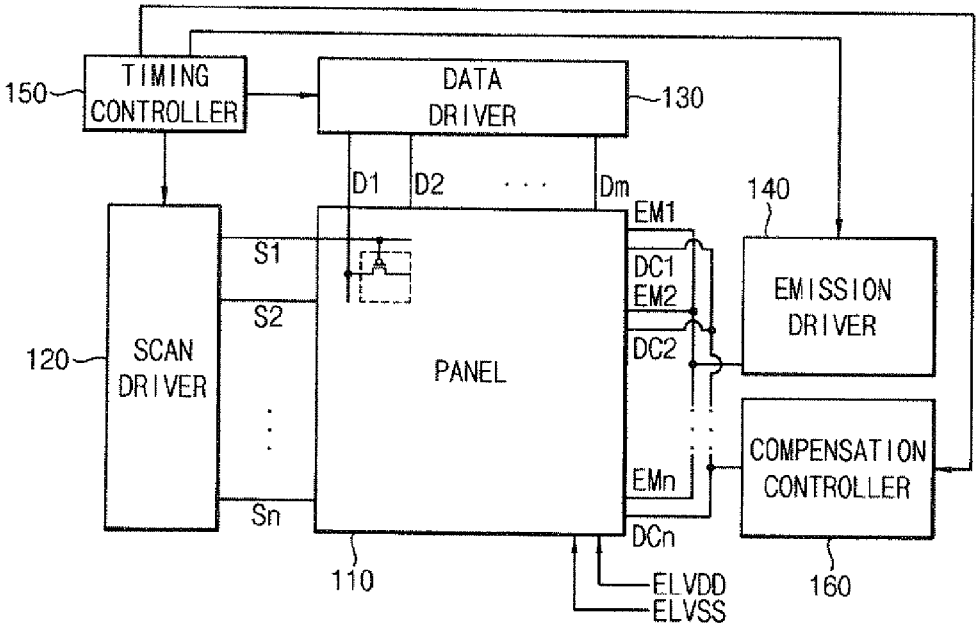
FIG. 9 is a block diagram illustrating an organic light emitting display (OLED) device according to other example embodiments.

FIG. 9 is a block diagram illustrating an organic light emitting display (OLED) device according to other example embodiments.

Referring to FIG. 9, except for the compensation controller 160, the organic light emitting display device 200 of FIG. 9 may have the same structure as the organic light emitting display device 100 of FIG. 8. The organic light emitting display device 200 of FIG. 9 may further include the compensation controller 160 that provides a compensation control signal to the display panel 110 via a plurality of compensation control-lines DC1 through Dcn.

In example embodiments, the length of a period during which the compensation control signal is applied may be determined based on a time point at which one of first through (n−1)th scan signals is applied to a gate electrode of a first transistor included in one pixel circuit. In detail, the compensation control signal may be controlled by the compensation controller 160 independently of the scan signals. For example, if the (n−3)th scan signal is applied to the gate electrode of the first transistor, the compensation control signal may be continuously applied while the (n−2)th scan signal and the (n−1)th scan signal are applied to other pixel circuits. Then, the compensation control signal may stop being applied just before the (n)th scan signal is applied to the one pixel circuit (i.e., the data programming operation is performed). Therefore, the threshold voltage of a driving transistor included in the one pixel circuit may be fully compensated.

Figure 10:
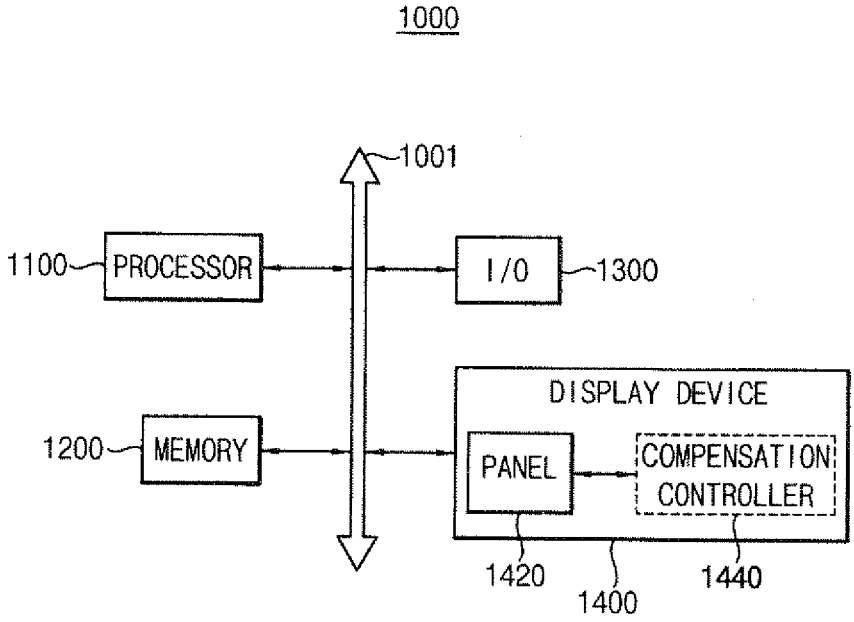
FIG. 10 is a block diagram illustrating an electric device having an organic light emitting display (OLED) device according to example embodiments.

FIG. 10 is a block diagram illustrating an electric device having an organic light emitting display (OLED) device according to example embodiments.

Referring to FIG. 10, the electric device 1000 may include a processor 1100, a memory device 1200, an input/output (I/O) device 1300, and a display device 1400. Here, the display device 1400 may correspond to the organic light emitting display device 100 of FIG. 8 or to the organic light emitting display device 200 of FIG. 9.

The processor 1100 may perform various computing functions. For example, the processor 1100 may be a micro processor, a central processing unit (CPU), etc. The processor 1100 may be coupled to other components via a bus 1001. For example, the processor 1100 may be coupled to the memory device 1200 and the display device 1400 via an address bus, a control bus, a data bus, etc. Furthermore, the processor 1100 may be coupled to an extended bus, such as a peripheral component interconnection (PCI) bus.

The memory device 1200 may include at least one non-volatile memory device and at least one volatile memory device. For example, the non-volatile memory device may correspond to an erasable programmable read-only memory (EPROM) device, an electrically erasable programmable read-only memory (EEPROM) device, a flash memory device, etc. In addition, the volatile memory device may correspond to a dynamic random access memory (DRAM) device, a static random access memory (SRAM) device, etc. The memory device 1200 may store software that is performed by the processor 1100.

The I/O device 1300 may be an input device such as a keyboard, a keypad, a mouse, a touch screen, etc, and an output device such as a printer, a speaker, etc. The I/O device 1300 may be coupled to the bus 1001. The processor 1100 may control the operations of the I/O device 1300.

The display device 1400 may be coupled to the processor 1100 via the bus 1001. The display device 1400 may include a display panel 1420. The display device 1400 may obtain a sufficient threshold voltage compensation time period regardless of a data programming time period by separately performing a threshold voltage compensating operation and a data programming operation for a driving transistor. In addition, the display device 1400 may prevent a non-uniform luminance due to hysteresis characteristics of the driving transistors (i.e., may improve luminance uniformity) by applying the same initial value to gate electrodes of driving transistors prior to the data programming operation.

In example embodiments, the display device 1400 may further include a compensation controller 1440. The compensation controller 1440 may provide a compensation control signal to the display panel 1420. The compensation control signal may be controlled independently of a plurality of scan signals that are sequentially provided to the display panel 1440. Thus, a threshold voltage compensation time period may be easily (i.e., independently) adjusted, and a data programming operation may be performed within a small time period. As a result, the contrast ratio may be improved, and the data programming operation may be performed at high speed.

The present invention may be applied to an electric device having a display device. For example, the present invention may be applied to an electric device such as a cellular phone, a smart phone, a smart pad, a personal digital assistant (PDA), a portable multimedia player (PMP), a digital camera, a computer, a laptop, a digital television, an MP3 player, etc. The foregoing is illustrative of example embodiments and is not to be construed as limiting thereof. Although a few example embodiments have been described, those skilled in the art will readily appreciate that many modifications of the example embodiments are possible without materially departing from the novel teachings and advantages of the present invention. Accordingly, all such modifications are intended to be included within the scope of the present invention as defined in the claims. Therefore, it is to be understood that the foregoing is illustrative of various example embodiments, and is not to be construed as limited to the specific example embodiments disclosed, and that modifications to the disclosed example embodiments, as well as other example embodiments, are intended to be included within the scope of the appended claims.

What is claimed is:

1. A method of driving a pixel circuit, comprising the steps of:

initializing a driving transistor and a storage capacitor by simultaneously applying an initialization voltage and a first power voltage to a gate electrode of the driving transistor and the storage capacitor, respectively;

diode-coupling the driving transistor;

applying a data voltage to the storage capacitor;

applying the data voltage to the gate electrode of the driving transistor by a coupling of a compensation capacitor coupled between the gate electrode of the driving transistor and the storage capacitor; and applying a current corresponding to the first power voltage and the data voltage to an organic light emitting diode that is coupled to the driving transistor.

2. The method of claim 1, wherein a voltage of the gate electrode of the driving transistor is changed to a voltage corresponding to the initialization voltage, and a data voltage of a previous frame stored in the storage capacitor is changed to a voltage corresponding to the first power voltage when the driving transistor and the storage capacitor are initialized.

3. The method of claim 2, wherein a voltage corresponding to a difference between the first power voltage and a threshold voltage of the driving transistor is applied to the gate electrode of the driving transistor when the driving transistor is diode-coupled.

4. The method of claim 3, wherein the first power voltage stored in the storage capacitor is changed to the data voltage, and the voltage of the gate electrode of the driving transistor is reduced by a difference between the first power voltage and the data voltage when the data voltage is applied to the storage capacitor.

5. The method of claim 4, wherein the data voltage is applied to the storage capacitor when the driving transistor stops being diode-coupled.

6. A pixel circuit, comprising:

an organic light emitting diode;

a driving transistor having a gate electrode coupled to a first node, a first electrode for receiving a first power voltage, and a second electrode coupled to the organic light emitting diode;

a first transistor coupled to the first node, the first transistor providing an initialization voltage to the gate electrode of the driving transistor in response to a reset signal;

a second transistor coupled between the second electrode of the driving transistor and the first node;

a compensation capacitor having a first electrode coupled to the first node and a second electrode coupled to a second node;

a storage capacitor having a first electrode coupled to the second node and a second electrode for receiving the first power voltage;

a third transistor coupled to the second node, the third transistor providing the first power voltage to the first electrode of the storage capacitor in response to a reference voltage control signal;

a fourth transistor coupled to the second node, the fourth transistor providing a data voltage to the first electrode of the storage capacitor in response to a scan signal; and a light emitting control transistor coupled between the second electrode of the driving transistor and the organic light emitting diode, the light emitting control transistor turning-on in response to a light emitting control signal.

7. The circuit of claim 6, wherein the driving transistor, the light emitting control transistor, and the first through fourth transistors are implemented by p-channel metal oxide semiconductor (PMOS) transistors.

8. The circuit of claim 7, wherein the reference voltage control signal and the reset signal are simultaneously applied.

9. The circuit of claim 8, wherein as first through (n)th scan signals, are sequentially provided, where n is an integer not less than 3, the scan signal corresponds to the (n)th scan signal, the reset signal corresponds to the (n−2)th scan signal, and the (n−1)th scan signal is applied to the gate electrode of the second transistor.

10. The circuit of claim 8, wherein as first through (n)th scan signals are sequentially provided, where n is an integer not less than 3, the scan signal corresponds to the (n)th scan signal, the reset signal corresponds to one of the first through (n−1)th scan signals, and a compensation control signal is applied to the gate electrode of the second transistor.

11. The circuit of claim 10, wherein a length of a period during which the compensation control signal is applied is determined based on a time point at which the reset signal is applied.

12. The circuit of claim 11, wherein the compensation control signal is applied when the reset signal stops being applied.

13. The circuit of claim 12, wherein the driving transistor is diode-coupled, and a voltage corresponding to a difference between the first power voltage and a threshold voltage of the driving transistor is applied to the gate electrode of the driving transistor while the compensation control signal is applied.

14. The circuit of claim 13, wherein the scan signal is applied when the compensation control signal stops being applied.

15. An organic light emitting display (OLED) device, comprising:

a display panel having a plurality of pixel circuits, the display panel receiving a first power voltage and a second power voltage;

a scan driver configured to sequentially provide first through (n)th scan signals to the pixel circuits via first through (n)th scan-lines, where n is an integer not less than 3;

a data driver configured to provide a data voltage to the pixel circuits via a plurality of data-lines based on the first through (n)th scan signals;

an emission driver configured to provide a light emitting control signal to the pixel circuits via a plurality of light emitting control-lines; and a timing controller configured to control the scan driver, the data driver and the emission driver;

wherein each of the pixel circuits includes:

an organic light emitting diode;

a driving transistor having a gate electrode coupled to a first node, a first electrode for receiving the first power voltage, and a second electrode coupled to the organic light emitting diode;

a first transistor coupled to the first node, the first transistor providing an initialization voltage to the gate electrode of the driving transistor in response to one of the first through (n−1)th scan signals;

a second transistor coupled between the second electrode of the driving transistor and the first node;

a compensation capacitor having a first electrode coupled to the first node and a second electrode coupled to a second node;

a storage capacitor having a first electrode coupled to the second node and a second electrode for receiving the first power voltage;

a third transistor coupled to the second node, the third transistor providing the first power voltage to the first electrode of the storage capacitor in response to a reference voltage control signal;

a fourth transistor coupled to the second node, the fourth transistor providing a data voltage to the first electrode of the storage capacitor in response to the (n)th scan signal; and a light emitting control transistor coupled between the second electrode of the driving transistor and the organic light emitting diode, the light emitting control transistor turning-on in response to the light emitting control signal.

16. The device of claim 15, wherein the (n−2)th scan signal is applied to the gate electrode of the first transistor, and the (n−1)th scan signal is applied to the gate electrode of the second transistor.

17. The device of claim 16, wherein the reference voltage control signal and the (n−2)th scan signal are simultaneously applied.

18. The device of claim 15, further comprising a compensation controller configured to provide a compensation control signal to the gate electrode of the second transistor.

19. The device of claim 18, wherein a length of a period during which the compensation control signal is applied is determined based on a time point at which one of the first through (n−1)th scan signals is applied to the gate electrode of the first transistor.

20. The device of claim 19, wherein the (n)th scan signal is applied when the compensation control signal stops being applied.

* * * * *